US008196299B2

(12) United States Patent
Lee et al.

(10) Patent No.: US 8,196,299 B2
(45) Date of Patent: Jun. 12, 2012

(54) CONNECTING TERMINAL FOR LITZ WIRE, MOUNTING METHOD FOR THE SAME AND MANUFACTURING METHOD FOR COOKING APPLIANCE

(75) Inventors: Sung Ho Lee, Suwon-si (KR); Jae Man Joo, Suwon-si (KR); Jong Chull Shon, Suwon-si (KR); Young Hoon Kang, Suwon-si (KR); Won Sick Jung, Hwaseong-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

(21) Appl. No.: 12/877,749

(22) Filed: Sep. 8, 2010

(65) Prior Publication Data

US 2011/0097949 A1 Apr. 28, 2011

(30) Foreign Application Priority Data

Oct. 22, 2009 (KR) ..... 10-2009-0100600
Aug. 30, 2010 (KR) ..... 10-2010-0083812
Sep. 8, 2010 (KR) ..... 10-2009-0084587

(51) Int. Cl.
*H01R 43/04* (2006.01)

(52) U.S. Cl. ..... 29/867

(58) Field of Classification Search ..... 29/599, 29/857–867, 890; 439/55, 878, 495–499, 439/517

See application file for complete search history.

(56) References Cited

U.S. PATENT DOCUMENTS 3,123,898 A * 3/1964 Touno ..... 29/613
6,601,289 B1 * 8/2003 Kobayashi ..... 29/599
2005/0184051 A1 * 8/2005 Johnston ..... 219/538
2005/0252910 A1 * 11/2005 O'Connor ..... 219/544

FOREIGN PATENT DOCUMENTS

| | | | |
|---|---|---|---|
| DE | 3915286 | | 11/1990 |
| DE | 19717317 | | 10/1998 |
| DE | 10340284 | | 3/2004 |
| DE | 102004044480 | | 2/2006 |
| JP | 404181663 | A * | 6/1992 |
| JP | 2003-332016 | | 11/2003 |
| KR | 10-2005-0052082 | | 6/2005 |
| KR | 10-2008-0106685 | | 12/2008 |
| WO | 97/04507 | | 2/1997 |
| WO | 2005/074077 | | 8/2005 |

OTHER PUBLICATIONS

European Search Report dated Dec. 23, 2010, issued in corresponding European Patent Application No. 10175070.1.

* cited by examiner

*Primary Examiner* — Jean F Duverne

(74) *Attorney, Agent, or Firm* — Staas & Halsey LLP

(57) ABSTRACT

A connection terminal of a litz wire, a mounting method thereof, and a manufacturing method of a cooking appliance with a working coil consisting of the litz wire. The mounting method includes preparing the litz wire including plural wires, each of which includes a sheath, installing one end of the litz wire at the connection terminal, removing the sheaths from the plural wires by heating the litz wire, and deforming the connection terminal through a pinch-off process, thereby connecting front ends of the wires through the connection terminal and removing the sheaths or sheath residues between cores of the wires, and thus reducing resistance of the litz wire.

21 Claims, 12 Drawing Sheets

CONNECTING TERMINAL FOR LITZ WIRE, MOUNTING METHOD FOR THE SAME AND MANUFACTURING METHOD FOR COOKING APPLIANCE

CROSS-REFERENCE TO RELATED APPLICATIONS

This application claims the benefit of Korean Patent Application No. 2009-0084587, filed on Sep. 8, 2009, No. 2009-0100600, filed on Oct. 22, 2009, and No. 2010-0083812, filed on Aug. 30, 2010, in the Korean Intellectual Property Office, the disclosures of which are incorporated herein by reference.

BACKGROUND

1. Field

Embodiments relate to a connection terminal of a litz wire, a mounting method thereof, and a manufacturing method of a cooking appliance with a working coil consisting of the litz wire.

2. Description of the Related Art

In general, cooking appliances are apparatuses which cook food through heat generated from a heat source. Among these cooking appliances, an induction heating-type cooking appliance which cooks food using heat due to an eddy current loss generated from a cooking container disposed in an alternating magnetic field and heat due to a hysteresis loss has been proposed.

Such a cooking appliance includes a cooking table on which a cooking container is placed, and at least one working coil disposed in the cooking table to perform induction heating of the cooking container.

The working coil is formed by disposing a litz wire consisting of plural wires in a spiral shape, and the plural wires constituting the litz wire respectively include a core made of a conductor and a sheath made of an insulator and coating the outer surface of the core such that the plural wires are insulated from each other through the sheaths thereof.

SUMMARY

Therefore, it is an to provide a connection terminal of a litz wire which supplies power from an external power source to the litz wire, a mounting method thereof, and a manufacturing method of a cooking appliance with a working coil consisting of the litz wire.

Additional aspects will be set forth in part in the description which follows and, in part, will be apparent from the description, or may be learned by practice of the invention.

In accordance with one aspect, a mounting method of a connection terminal of a litz wire includes preparing the litz wire including plural wires, each of which includes a sheath, installing one end of the litz wire at the connection terminal, removing the sheaths from the plural wires by heating the litz wire, and deforming a fixing part of the connection terminal through a pinch-off process.

The fixing part of the connection terminal may be deformed such that an interval between both sides of the fixing part become narrowed, and be cut together with the end of the litz wire through the pinch-off process.

At least a part of residues of the sheaths removed from the plural wires may be removed by narrowing intervals between the plural wires through the pinch-off process.

The litz wire may be heated through the connection terminal by heating the connection terminal under the condition that the end of the litz wire is installed at the connection terminal.

The pinch-off process may be performed under the condition that the connection terminal is heated.

The connection terminal and the plural wires from which the sheaths are removed may be fused to each other by continuously heating the connection terminal.

The connection terminal may include a ring connection part formed in a ring shape.

The litz wire may be installed at the connection terminal in a first direction, and the ring connection part is extended in a second direction.

The connection terminal may include the fixing part where the litz wire is installed, and the fixing part may be deformed to have a ring shape in which both ends of the fixing part in the widthwise direction thereof are opposite to each other so as to allow the litz wire to be fixed to the inside of the fixing part.

The fixing part have a width set to be 105~115% of a circumferential length of the litz wire.

Each of the plural wires may include a core made of a conductive material, and the sheath provided at the outer surface of the core and made of an insulating material.

The core may be made of aluminum, and the sheath may be made of enamel.

The sheath of each wire may be removed by heating the connection terminal at which the litz wire is installed to a temperature of 230~300° C.

In accordance with another aspect, a connection terminal of a litz wire includes a fixing part in which the litz wire including a plurality of wires, each of which includes a sheath, wherein the fixing part is deformed such that an interval between both sides of the fixing part become narrowed through a pinch-off process.

In accordance with another aspect, a mounting method of a connection terminal of a litz wire includes preparing the litz wire including plural wires, installing one end of the litz wire at a fixing part of the connection terminal, and deforming the connection terminal through a pinch-off process under the condition that ends of the plural wires are installed at the connection terminal, such that an interval between both sides of the fixing part becomes narrowed In accordance with another aspect, a mounting method of a connection terminal of a litz wire includes preparing the litz wire including plural wires, each of which includes a sheath, installing one end of the litz wire at a fixing part of the connection terminal, and removing the sheath from each of the plural wires constituting the litz wire by heating the fixing part at which the litz wire is installed.

In accordance with a further aspect, a manufacturing method of a cooking appliance, which has a cooking table on which cooking containers containing food are placed, working coils to heat the cooking containers, and connection terminals respectively installed at the working coils, includes preparing a litz wire including plural wires, each of which includes a sheath, installing one end of the litz wire at a fixing part provided on the connection terminal to install the litz wire, removing the sheath from each of the plural wires by heating the connection terminal, and cutting and deforming a portion of the fixing part together with the end of the litz wire through a pinch-off process.

BRIEF DESCRIPTION OF THE DRAWINGS

These and/or other aspects will become apparent and more readily appreciated from the following description of the embodiments, taken in conjunction with the accompanying drawings of which.

DETAILED DESCRIPTION

Figure 1:
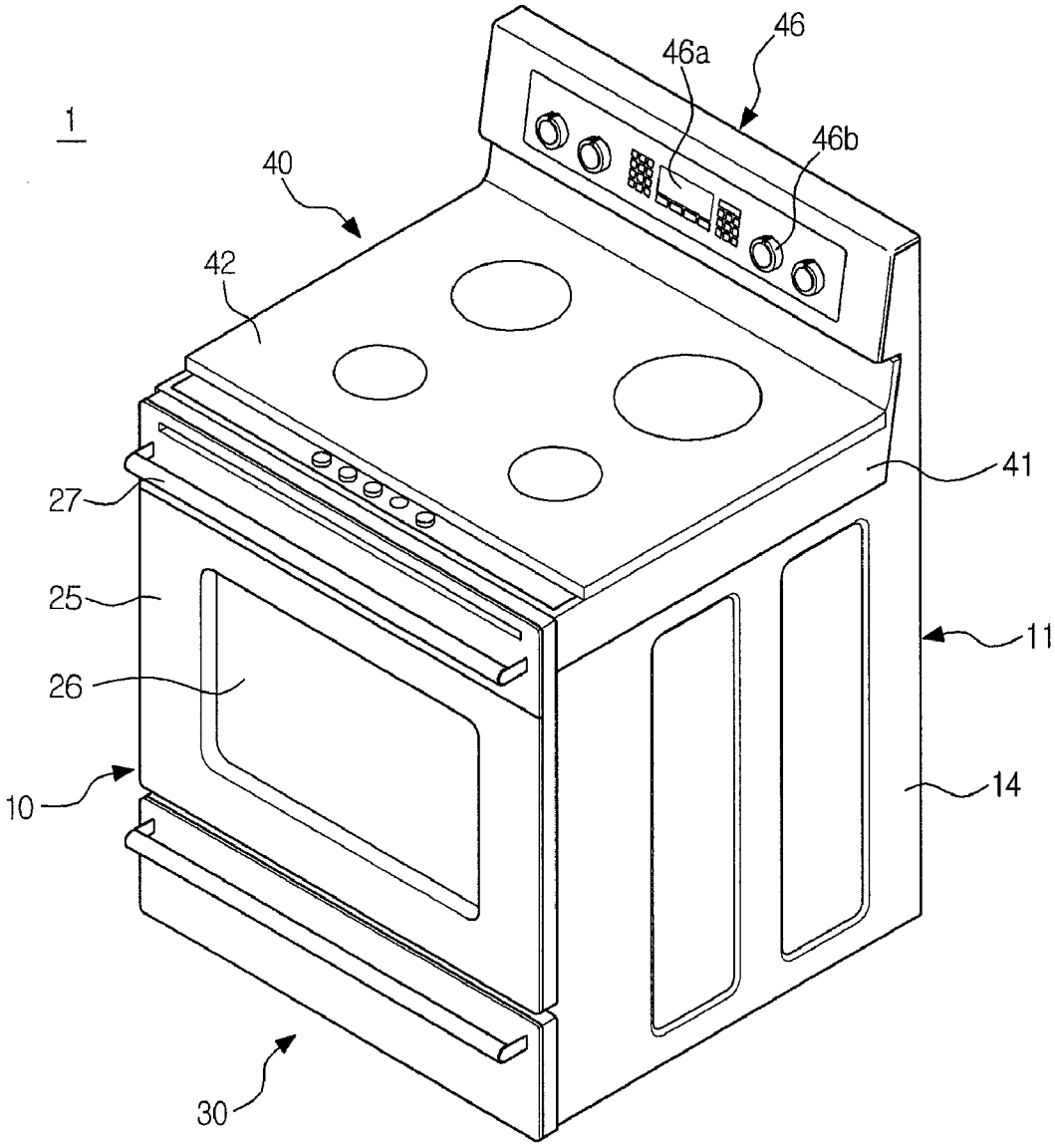
FIG. 1 is a perspective view of a cooking appliance in accordance with one embodiment.

Reference will now be made in detail to the embodiments, examples of which are illustrated in the accompanying drawings, wherein like reference numerals refer to the like elements throughout.

Hereinafter, a cooling appliance, to which a litz wire in accordance with one embodiment of the present invention is applied, will be described with reference to the accompanying drawings.

Figure 2:
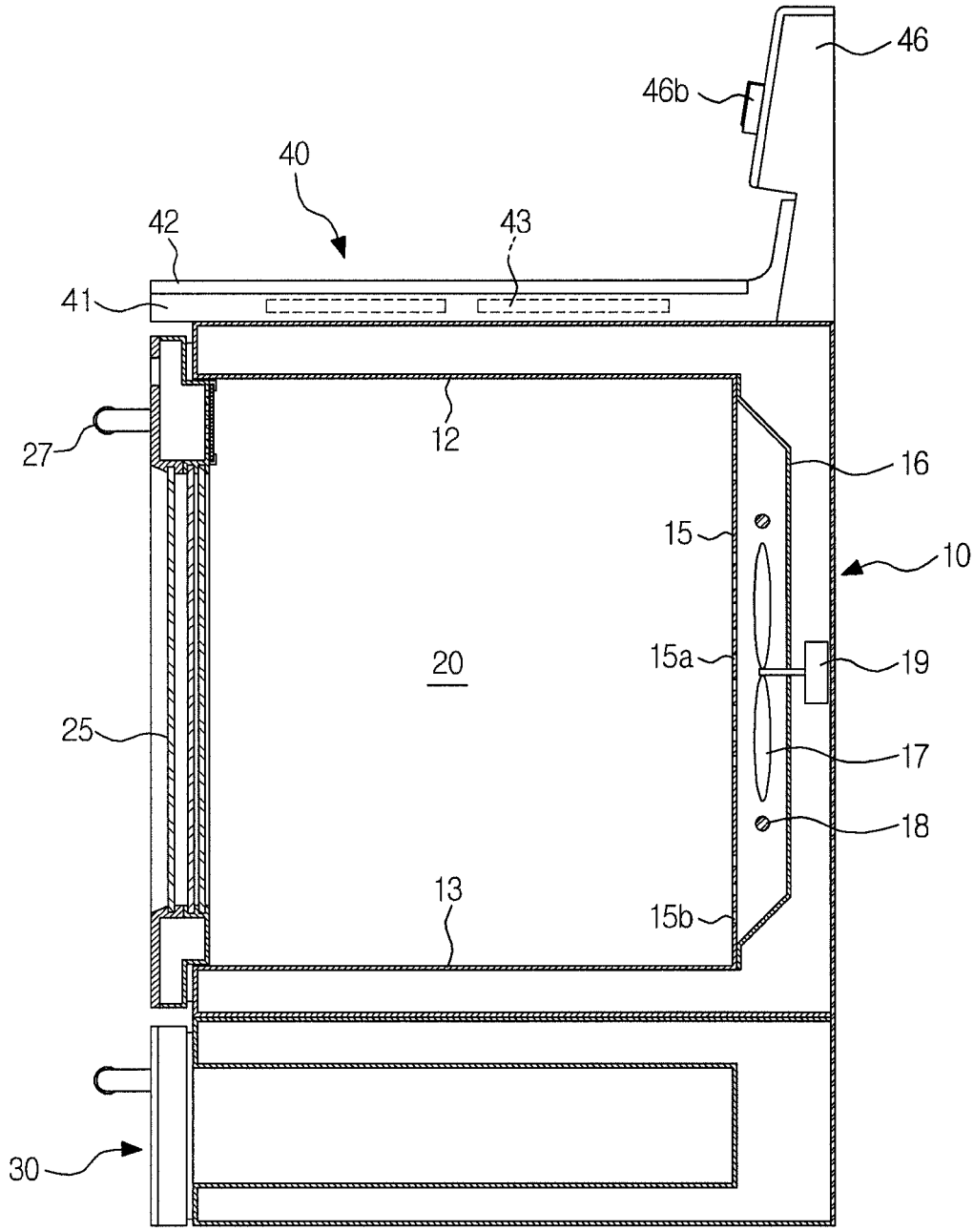
FIG. 2 is a longitudinal-sectional view of the cooking appliance in accordance with the embodiment.

As shown in FIGS. 1 and 2, a cooking appliance 1, to which a litz wire in accordance with one embodiment is applied, includes an oven 10 provided so as to cook food in an airtight state, a cook top frame 40 provided on the upper surface of the oven 10 so as to cook food under the condition that cooking containers (not shown) are placed upon the cook top frame 40, and a drawer 30 provided under the oven 10 so as to perform a storage function and a simple cooking function.

The oven 10 cooks food through heat convection. The oven 10 includes a body 11, a cavity 20 formed within the body 11, and an oven door 25 to open and close the opened front surface portion of the cavity 20.

The body 11 includes a top plate 12, a bottom plate 13, both side plates 14, and a rear plate 15, which may be formed integrally or separately. A fan cover 16 is connected to the outer surface of the rear plate 15, and a convection fan 17 to circulate air in the cavity 20 is installed within the fan cover 16. A convection heater 18 is installed at the outer circumferential surface of the convention fan 17, and a fan motor 19 to drive the convection fan 17 is installed at the rear of the fan cover 16.

A plurality of suction holes 15*a* to inhale air in the cavity 20 is formed through a central portion of the rear plate 15 opposite to the convection fan 17, and a plurality of discharge holes 15*b* to supply hot air to the inside of the cavity 20 is formed through an edge of the rear plate 15.

The cavity 20 has an approximately rectangular parallelepiped structure, the front surface of which is opened. Racks (not shown) to support food so as to cook the food at a proper position are mounted in the cavity 20. Here, various racks may be applied according to size and kind of food.

The oven door 25 is hinged to lower portions of the front surfaces of both side plates 14, and is provided with a see-through front window 26 to expose the inside of the cavity 20. A handle 27 easily gripped by a user to allow the user to open and close the oven door 25 is protruded from an upper portion of the front surface of the oven door 25. That is, when the user pulls the handle 27 forward, the oven door 25 opens the cavity 20.

The drawer 30 is provided so as to simply store food or tools necessary for cooking. A separate heater (not shown) to heat cooked food or prepare simple food may be provided in the drawer 30.

That is, in the cooking appliance 1 in accordance with the embodiment of the present invention, when the user operates the oven 10 under the condition that food is placed into the cavity 20, the convection heater 18 emits heat, and the convection fan 17 is rotated by the fan motor 19. Then, air within the cavity 20 is inhaled into the suction holes 15*a*, is heated by the convection heater 18, and then is supplied again to the inside of the cavity 20 through the discharge holes 15*b*. The supplied hot air is circulated in the cavity 20, thus cooking the food in the cavity 20.

Figure 3:
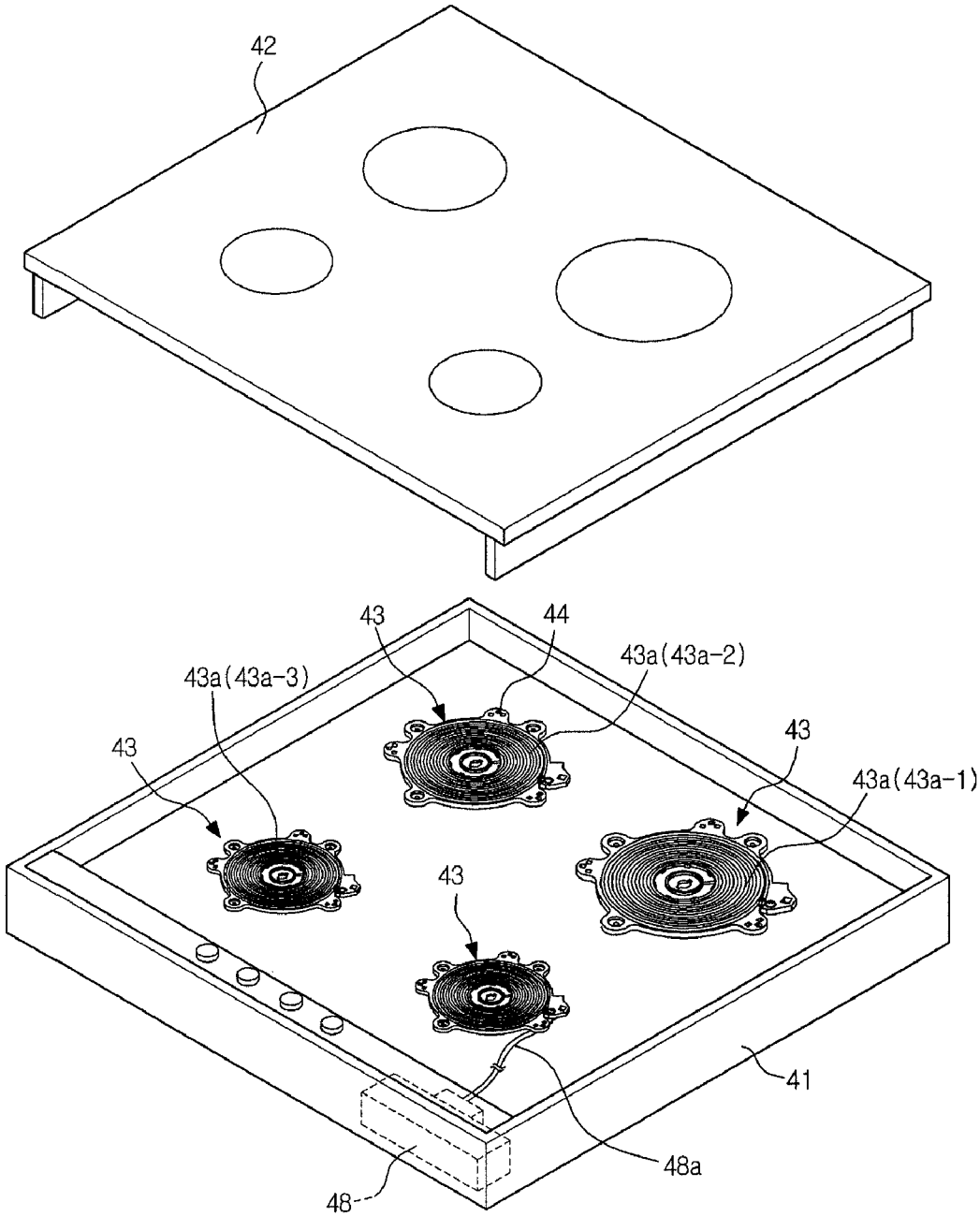
FIG. 3 is an exploded perspective view illustrating a cook top frame of the cooking appliance in accordance with the embodiment.
Figure 4:
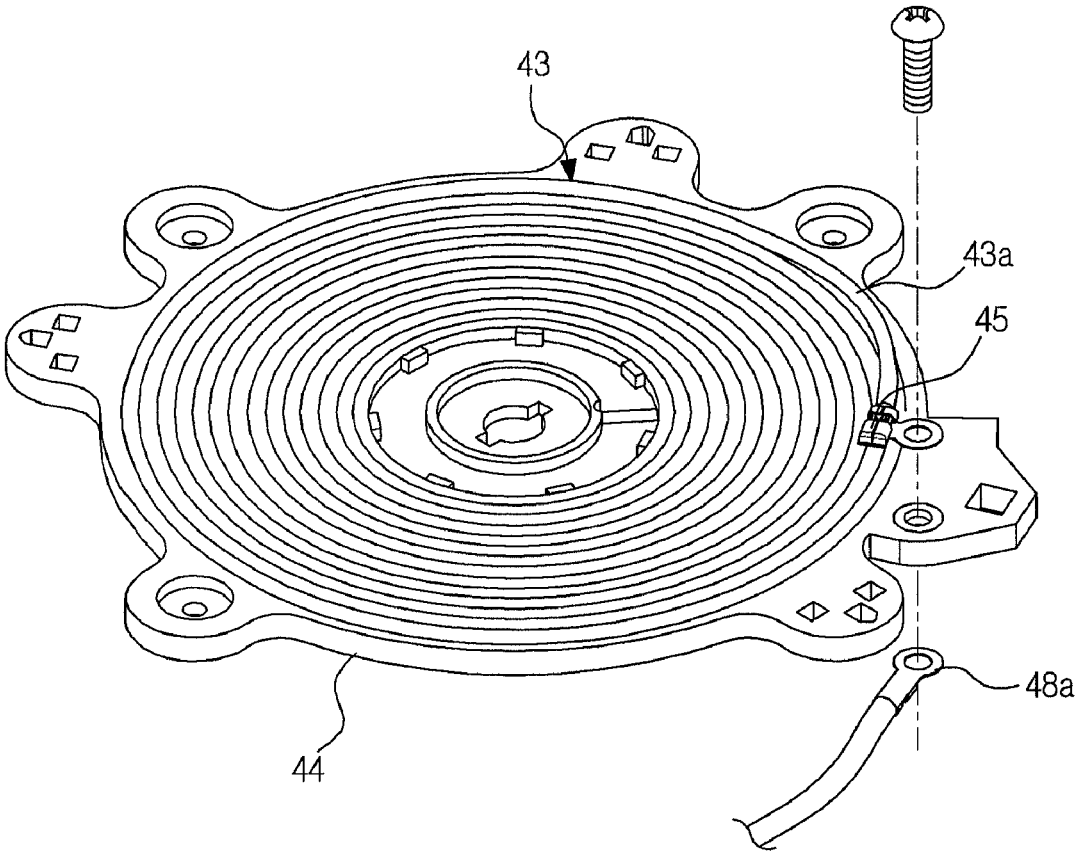
FIG. 4 is a perspective view illustrating a working coil of FIG. 3.

The cook top frame 40, as shown in FIGS. 3 and 4, includes a case 41, a cooking table 42, working coils 43, and a control unit 46.

The case 41 houses various parts and electronic components forming the cook top frame 40, including the working coils 43 and the control unit 46.

The cooking table 42 is disposed above the case 41, and is provided in a plate shape such that cooking containers may be placed on the cooking table 42. The cooking table 42 may be made of tempered glass so as not to be easily broken or scratched.

The control unit 46 is protruded upwardly from the rear end of the case 41. The control unit 46 serves to adjust operations of the oven 10 and the cook top frame 40. The control unit 46 includes a display 46*a* to display operation states and cooking times of the oven 10 and the cook top frame 40, and a series of operation knob 46*b* to adjust the operations of the oven 10 and the cook top frame 40.

The working coils 43 to heat the cooking containers placed on the cooking table 42 and coil bases 44 to respectively support the working coils 43 are installed on the cooking table 42. Here, the plural working coils 43 are disposed on the cooking table 42 so as to cook various foods simultaneously. The plural working coils 43 have different sizes to heat foods at different temperatures. This embodiment illustrates four working coils 43. Therefore, when power is supplied to the working coil 43, an alternating magnetic field is generated in the working coil 43, and is applied to a cooking container placed upon the cooking table 42, thereby generating heat.

The working coils 43 are made of a litz wire 43*a* consisting of a plurality of twisted wires. Each of the plurality of wires includes a core made of a conductor and a sheath made of an insulator and coating the outer surface of the core, and the working coils 43 are formed by disposing the litz wire 43*a* in a spiral shape. In this embodiment, the litz wire 43*a* is formed by the plurality of wires, each of which includes the core made of aluminum, and the sheath made of enamel coats the outer surface of the core.

The litz wire 43*a* is formed by twisting the plurality of the wires, as described above. Here, the litz wire 43*a* is formed by twisting 80, 120, or 160 wires according to sizes of the working coils 43. The litz wire 43*a* formed by twisting the wires made of aluminum has low production costs and light weight, compared with a litz wire formed by twisting wires made of copper.

Figure 5:
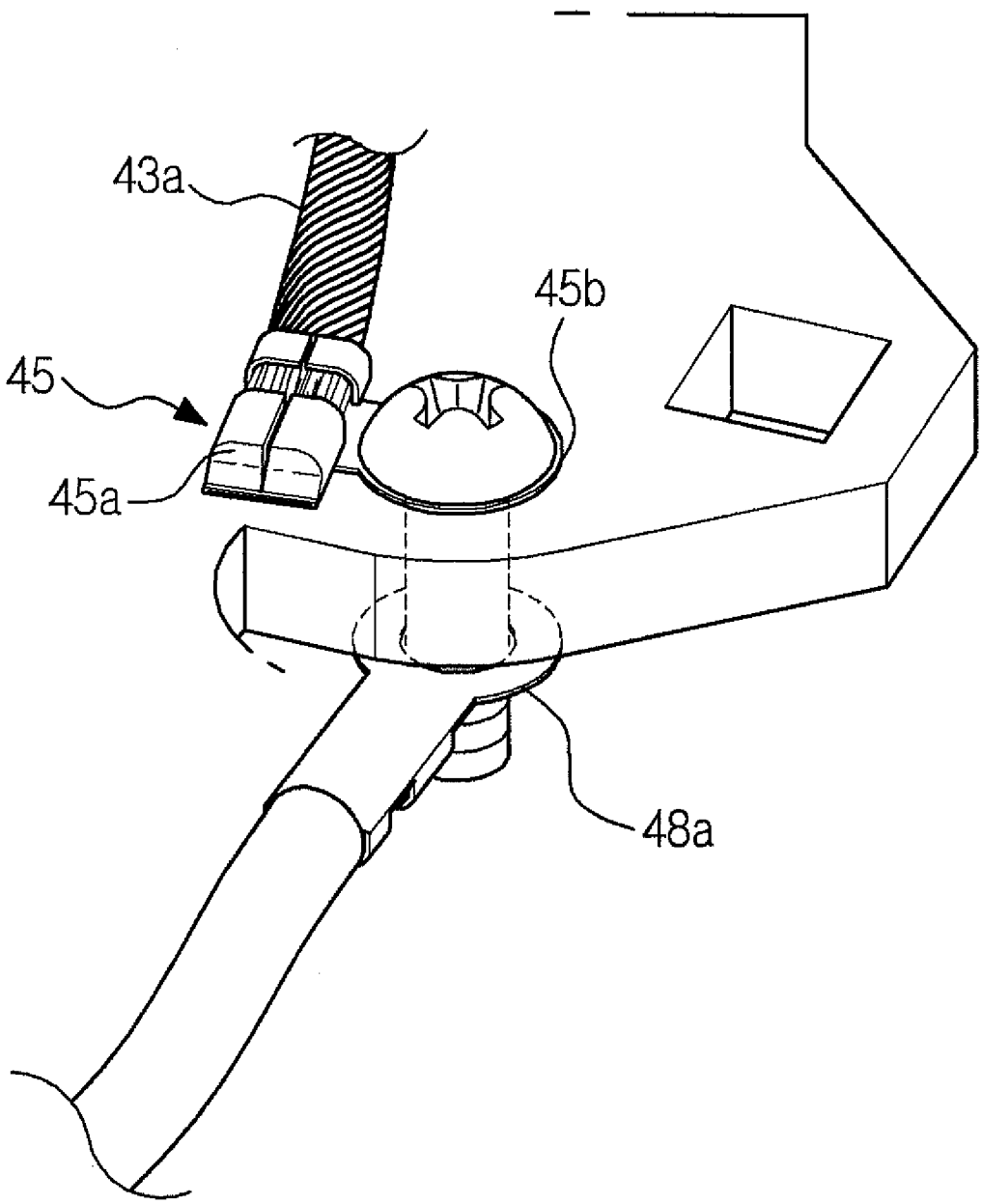
FIG. 5 is an enlarged perspective view illustrating a connection part of a litz wire of the working coil and a connection terminal of FIG. 4.

The litz wire 43*a* is connected to an inverter 48, as shown in FIG. 5, and is connected to an interface terminal 48*a* extended from the inverter 48.

In order to connect the litz wire 43*a* to the interface terminal 48*a*, a connection terminal 45 is mounted at one end of the litz wire 43*a*. The connection terminal 45, as shown in FIG. 6, includes a fixing part 45*a* bent in a ring shape such that one end of the litz wire 43*a* is installed at the inside of the fixing part 45*a*, and a ring connection part 45*a* formed in a ring shape at one side of the fixing part 45*a* so as to allow the connection terminal 45 to be connected to the interface terminal 48*a* through a screw.

Since the sheath made of enamel is formed on the outer surface of each of the respective wires constituting the litz wire 43*a*, as describe above, in order to electrically connect the litz wire 43*a* and the connection terminal 45, the cores of the wires are exposed by removing the sheaths made of an insulator, i.e., enamel, and then are connected to the connection terminal 45.

Hereinafter, a mounting method of the connection terminal on the litz wire will be described with reference to the accompanying drawings.

Figure 6:
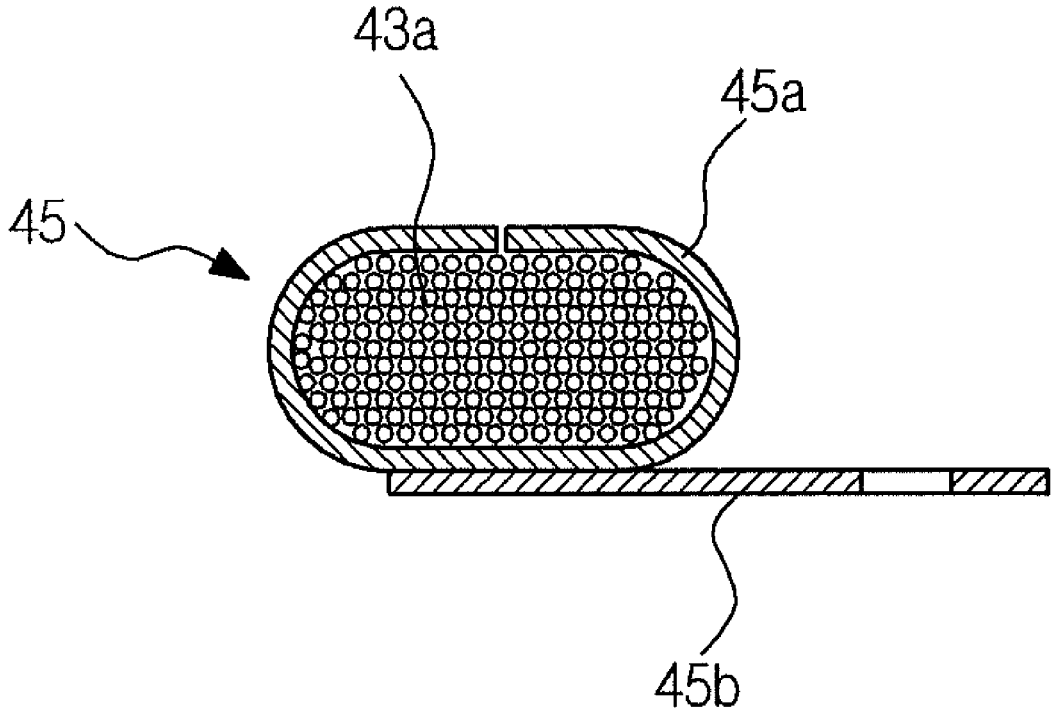
FIG. 6 is a sectional view of the connection part of FIG. 5.
Figure 7:
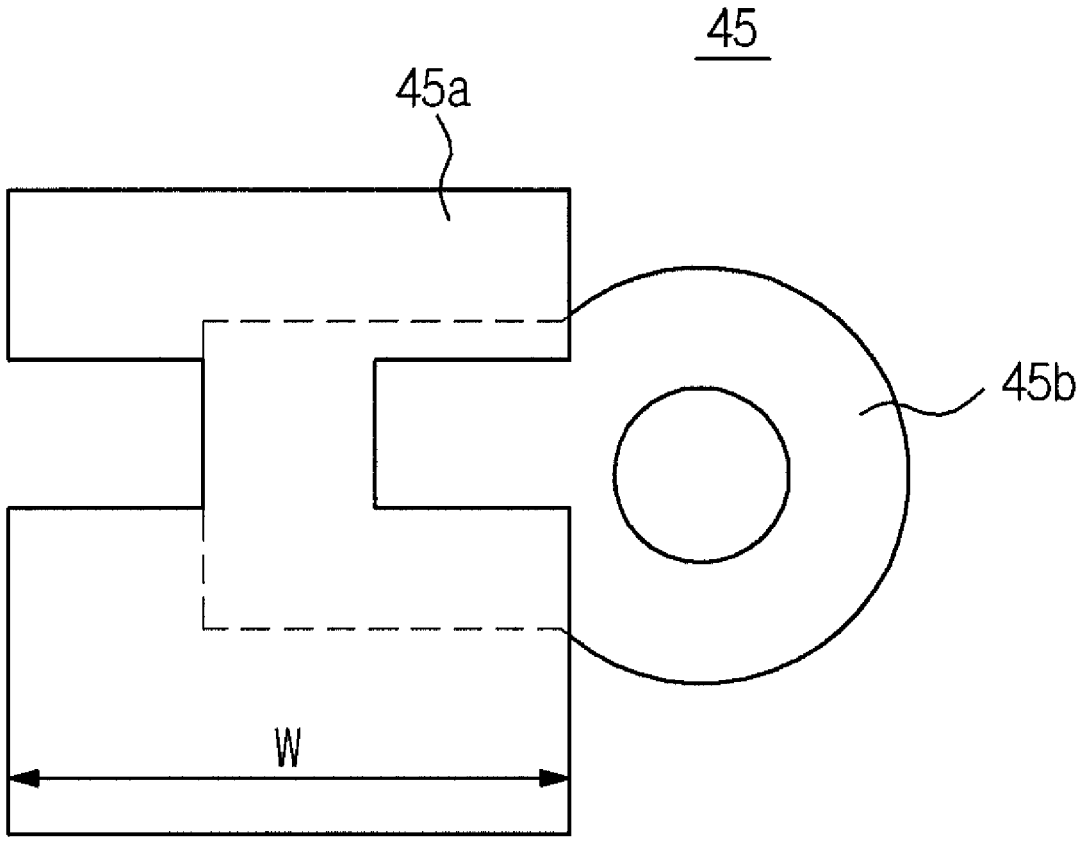
FIG. 7 is a development view of the connection terminal applied to the cooking appliance in accordance with the embodiment.

First, one end of the litz wire 43*a* including a plurality of wires is disposed on the fixing part 45*a* prior to deformation, i.e., the fixing part 45*a* flattened in a panel shape, as shown in FIG. 7, and then both ends of the fixing part 45*a* in the widthwise direction of the fixing part 45*a* are deformed through a presser (not shown) so as to surround the litz wire 43*a*, as shown in FIG. 6, thereby allowing one end of the litz wire 43*a* to be pressed onto the inside of the fixing part 45*a* and thus fixing the litz wire 43*a* to the fixing part 45*a*.

Here, the fixing part 45*a* is deformed to have a ring shape, i.e., an approximately oval shape, as shown in FIG. 6, so that both ends of the fixing part 45*a* in the widthwise direction are opposite to each other. If both ends of the fixing part 45*a* enter the inside of the litz wire 43*a*, force applied by the presser is concentrated onto a specific region of the litz wire 43*a* through both ends of the fixing part 45*a*, and thus may cause short circuit of the wires constituting the litz wire 43*a*. Such deformation of the fixing part 45*a* serves to prevent the short circuit.

In order to deform the fixing part 45*a* to have a ring shape in which both ends of the fixing part 45 are opposite to each other, the width W of the fixing part 45*a* is set to 105~115% of the circumferential length of the litz wire 43*a*.

Figure 8:
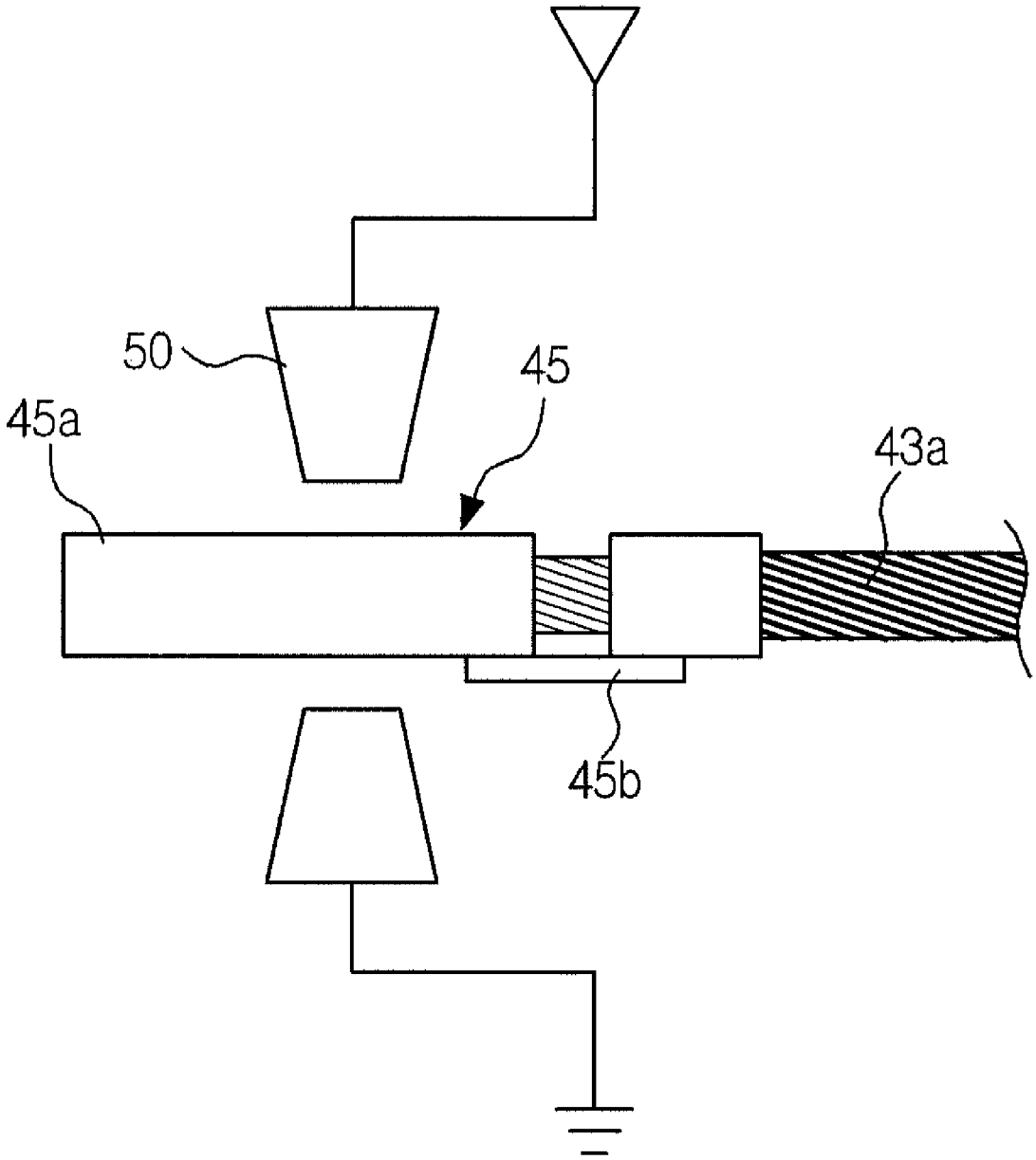
FIG. 8 is a schematic view illustrating a method of removing a sheath from a wire using heating in accordance with one embodiment.

After the litz wire 43*a* is fixed to the fixing part 45*a* of the connection terminal 45, as described above, heat is applied to the litz wire 43*a* through a heating device 50, as shown in FIG. 8, so as to remove the sheaths of the wires constituting the litz wire 43*a* through fusion. When the sheaths of the wires are removed through fusion by heat, the wires are connected to each other through the cores thereof, and the cores of the wires adjacent to the connection terminal 45 are connected to the connection terminal 45. Thereby, one ends of the wires are connected through the fixing part 45*a* of the connection terminal 45.

In this embodiment, the connection terminal 45 is heated through the heating device 50 which heats an object to be heated by applying high voltage power to the object, i.e., through indirect heating. The heating device 50 to heat the litz wire 43*a* including the wires, each of which includes the core made of aluminum and the sheath made of enamel, heats the litz wire 43*a* to a temperature of 230~300° C. If the heating wire 50 heats the litz wire 43*a* to a temperature of less than 230° C., the sheaths made of enamel are not sufficiently removed from the cores even if a designated time elapses, and if the heating wire 50 heats the litz wire 43*a* to a temperature of more than 300° C., the litz wire 43*a* may burn within a short period of time. Therefore, in order to prevent the above problems, the heating device 50 may heat the litz wire 43*a* to a temperature of 230~300° C.

Here, the heating device 50 is preheated to a temperature 170~240° C., and then is raised to the proper temperature of 230~300° C. during heating of the litz wire 43*a*. When the heating device 50 is controlled like this, the temperature of the heating device 50 is raised to the proper temperature to heat the litz wire 43*a* in a short period of time, and thus removal of the sheaths may be rapidly achieved by the heating device 50 while preventing the litz wire 43*a* from burning due to transmission of excessive heat to the litz wire 43*a*.

Such a heating device 50 heats the connection terminal 45 to which the litz wire 43*a* is connected, and the litz wire 43*a* is heated by heat transmitted from the connection terminal 45 such that the sheaths formed on the outer surfaces of the wires constituting the litz wire 43*a* are removed through fusion by the heat transmitted from the connection terminal 45.

Table below represents resistance values of the litz wires 43*a* if the width W of the fixing part 45*a* of the connection part 45 is set to 105~115% of the circumferential length of the litz wires 43*a*, the fixing part 45*a* of the connection terminal 45 is deformed so that both ends of the fixing part 45*a* in the widthwise direction are opposite to each other, and the litz wires 43*a* are heated to a temperature of 230~300° C.

| | Aluminum (mΩ) | | |
|---|---|---|---|
| Diameter of litz wire (ϕ) | First condition | Second condition | Third condition |
| 160 | 488 | 91.5 | 83.1 |
| 180 | 105 | 58.0 | 52.6 |
| 210 | 420 | 45.0 | 40.9 |

In above Table, resistance values in the first condition represent resistance values according to diameters of the litz wires 43*a* if a conventional connection terminal is used, resistance values in the second condition represent resistance values according to diameters of the litz wires 43*a* if the width W of the fixing part 45*a* of the connection part 45 is set to 105~115% of the circumferential length of the litz wires 43*a*, and resistance values in the third condition represent resistance values according to diameters of the litz wires 43*a* if the width W of the fixing part 45*a* of the connection part 45 is set to 105~115% of the circumferential length of the litz wires 43*a*, the fixing part 45*a* of the connection terminal 45 is deformed so that both ends of the fixing part 45*a* in the widthwise direction are opposite to each other, and the litz wires 43*a* are heated to a temperature of 230~300° C. Here, each of the respective resistance values is the mean of resistance values obtained by installing the litz wire 43*a* in the connection terminal 45 twenty times according to each condition.

As seen from above Table, the resistance value of the litz wire 43*a* may be greatly reduced only by adjusting the width W of the fixing part 45*a* of the connection terminal 45, compared with the conventional connection terminal, and the resistance value of the litz wire 43*a* may be more greatly reduced if the fixing part 45*a* of the connection terminal 45 is deformed so that both ends of the fixing part 45*a* in the widthwise direction are opposite to each other, and the litz wires 43*a* are heated to a temperature of 230~300° C. Further, when the connection terminal 45 and the end of the litz wire 43*a* are continuously heated through the heating device 50 for more than a designated time even after the sheaths of the wires constituting the litz wire 43*a* are removed, the cores of the wires and the connection terminal 45 are fused to each other, and thus connection between the connection terminal 45 and the litz wire 43*a* is more stably achieved and resistance is reduced.

Figure 9:
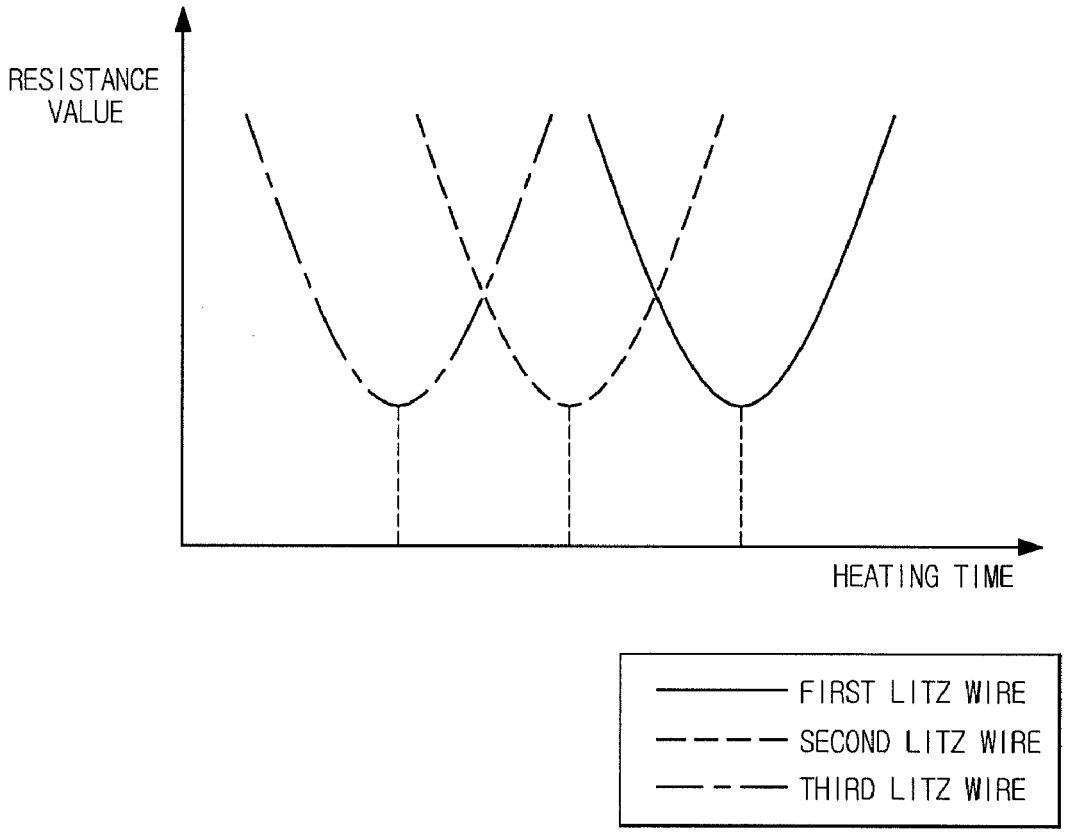
FIG. 9 is a graph illustrating heating times of respective litz wires according to the number of wires forming the respective litz wires.

As described above, the working coils 43 are formed by the litz wire 43*a* including the different numbers of the wires according to sizes of the working coils 43. As shown in FIG. 9, heating times of the connection terminals 45 mounted on the respective litz wires 43*a* are varied according to the number of the wires forming the respective litz wires 43*a*.

In a graph of FIG. 9, a Y-axis represents resistance values of the respective litz wires 43*a*, and an X-axis represents heating times of the respective litz wires 43*a*. Further, as shown in FIG. 9, a first litz wire 43*a*-1 includes 160 wires, a second litz wire 43*a*-2 includes 120 wires, and a third litz wire 43*a*-3 includes 80 wires.

As seen from FIG. 9, as heating times of the respective litz wires 43*a*-1, 43*a*-2, and 43*a*-3 decrease, the sheaths of the wires are not sufficiently removed, and the connection terminals 45 are not sufficiently electrically connected to the wires of the respective litz wires 43*a*-1, 43*a*-2, and 43*a*-3, and thereby the litz wires 43*a*-1, 43*a*-2, and 43*a*-3 may have high resistance values. On the other hand, as the heating times of the respective litz wires 43*a*-1, 43*a*-2, and 43*a*-3 increase, the wires disposed at the edges of the respective litz wires 43*a*-1, 43*a*-2, and 43*a*-3 are damaged by heat, and thereby the litz wires 43*a*-1, 43*a*-2, and 43*a*-3 may have high resistance values.

Therefore, the heating times of the respective litz wires 43*a*-1, 43*a*-2, and 43*a*-3 are set to values if the resistance values generated from the respective litz wires 43*a*-1, 43*a*-2, and 43*a*-3 when power is applied to the respective litz wires 43*a*-1, 43*a*-2, and 43*a*-3 are minimum, so as to sufficiently electrically connect the wires without damage to the wires, as shown in FIG. 9.

If the sheathes of the wires are removed by heating the connection terminal 45, the sheaths of the wires located at the edge of the litz wire 43*a* are effectively removed by heat transmitted directly through the connection terminal 45, but the sheaths of the wires located at the center of the litz wire 43*a* do not sufficiently receive heat through the connection terminal and thus are not sufficiently removed. Thus, the overall resistance of the litz wire 43*a* may be increased by the remaining sheaths.

Therefore, in this embodiment, the connection terminal 45 is configured such that a portion of the fixing part 45*a* of the connection terminal 45 is cut and deformed together with the litz wire 43*a* under the condition that the litz wire 43*a* is installed within the connection terminal 45. In this embodiment, one end of the litz wire 43*a* is installed within and connected to the fixing part 45*a* of the connection terminal 45 in a first direction, and the ring connection part 45*b* is extended from the fixing part 45*a* at one side of the connection terminal 45 in a second direction perpendicular to the first direction such that cutting of the connection terminal 45 is easily carried out.

Figure 10:
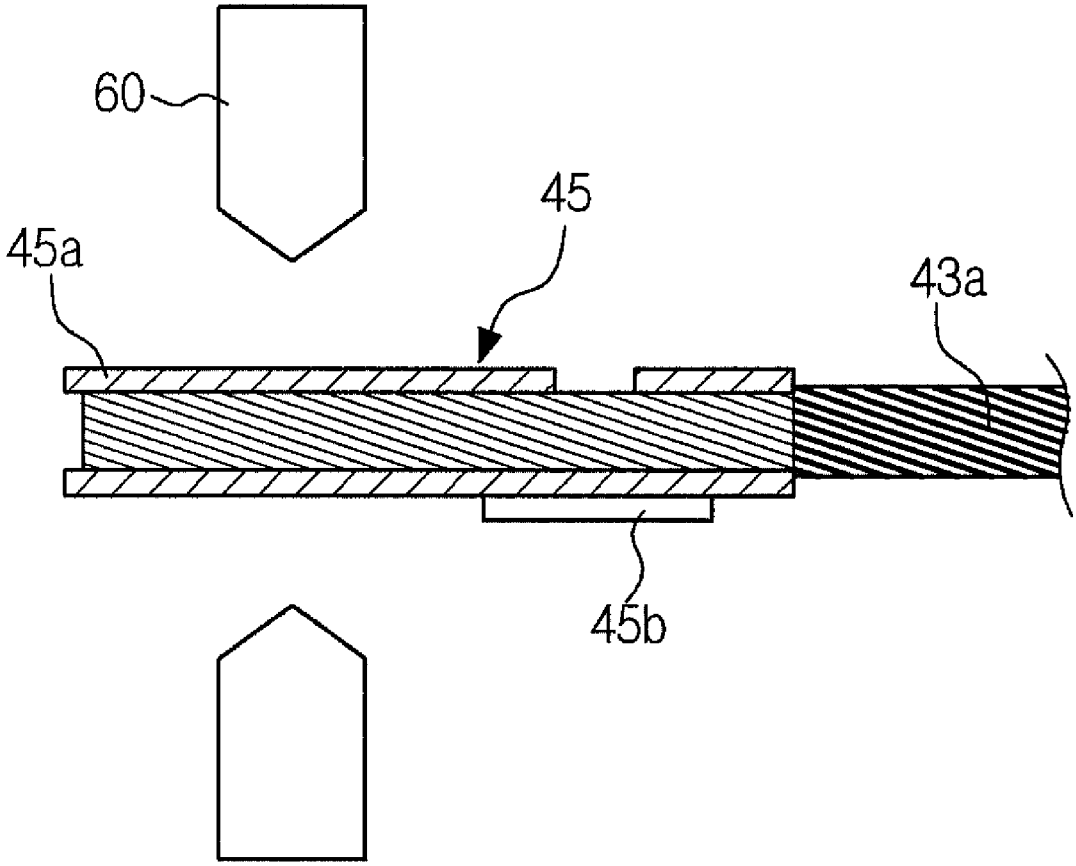
FIGS. 10 and 11 are schematic views illustrating a method of cutting a fixing part and the litz wire through a pinch-off process.
Figure 11:
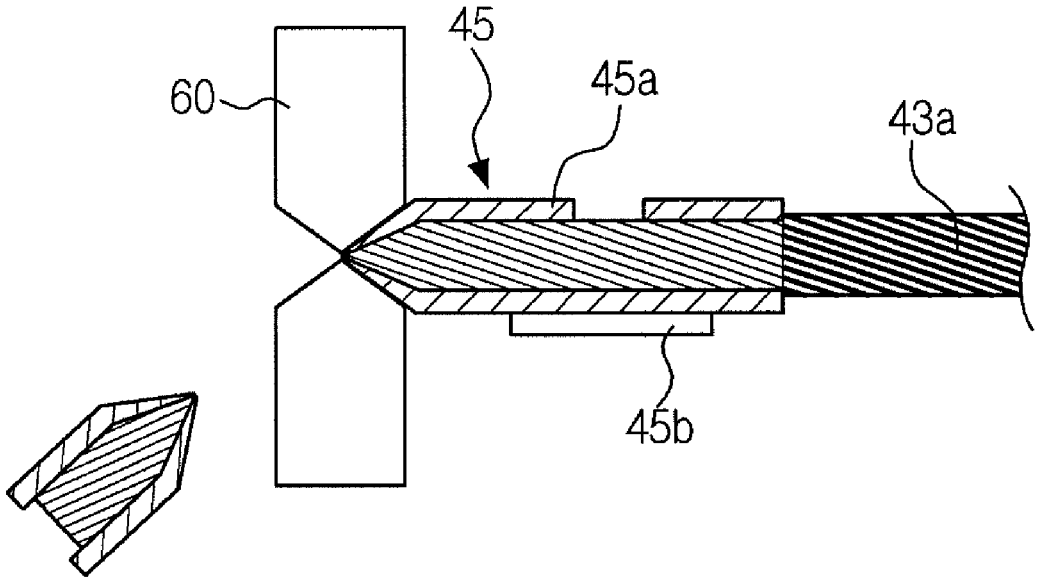

FIGS. 10 and 11 illustrate deformation and cutting of the fixing part 45*a* of the connection terminal 45 by performing a pinch-off process as to the connection terminal 45 and the litz wire 43*a* through a pinch-off apparatus 60 under the condition that the connection terminal 45 is installed on the litz wire 43*a*. In this embodiment, the pinch-off process is performed under the condition that the connection terminal 45 is heated so as to easily deform the connection terminal 45. That is, the reason why the pinch-off process is performed while or just after the sheaths of the wires are removed by heat is that the connection terminal 45 under the heated state is easily deformed and cut by heat.

When the fixing part 45*a* of the connection terminal 45 and the front end of the litz wire 43*a* are cut through the above pinch-off process, a partial section of the fixing part 45*a* of the connection terminal 45 adjacent to the cut-off part is deformed such that an interval between both sides is narrowed in consideration of characteristics of the pinch-off process, and the front end of the litz wire 43*a* newly formed after the cutting contacts the inner surface of the deformed connection terminal 45. Thereby, the wires constituting the litz wire 43*a* are electrically connected to each other through the deformed part of the connection terminal 45.

Further, when the pinch-off process is performed under the condition that the sheaths of the wires are heated, not only intervals between the wires but also intervals between the cores of the wires are narrowed, and thus the sheaths or sheath residues between the cores are at least partially deformed and expelled and removed from spaces between the cores and the cores are more effectively connected to each other.

Therefore, the sheaths are more effectively removed through the pinch-off process, and thus the cores of the wires are more effectively connected. Further, the wires are connected to each other through the connection terminal 45 connected to the front ends thereof even if the sheaths of the wires are not sufficiently removed, thereby greatly lowering the overall resistance value of the litz wire 43*a*.

Table below represents resistance values of litz wires before the pinch-off process and after the pinch-off process, measured by a test.

TABLE 2

| Litz wire | 1 | 2 | 3 | 4 | 5 | 6 | 7 | 8 |
|---|---|---|---|---|---|---|---|---|
| Resistance value before pinch-off process | 1.019 | 12.272 | 2.413 | 1.406 | 1.926 | 6.955 | 1.373 | 5.043 |
| Resistance value after pinch-off process | 0.815 | 0.814 | 0.816 | 0.818 | 0.820 | 0.835 | 0.829 | 0.824 |

In order to obtain above Table, the test is performed in which a litz wire 43*a* formed by twisting 8 litz wires, each of which is formed by twisting 20 wires, is used. That is, the litz wire 43*a* consisting of a total of 160 wires is used. The resistance values are means of the measured resistance values of each of the 8 litz wires constituting the litz wire 43*a* 20 times.

Figure 12:
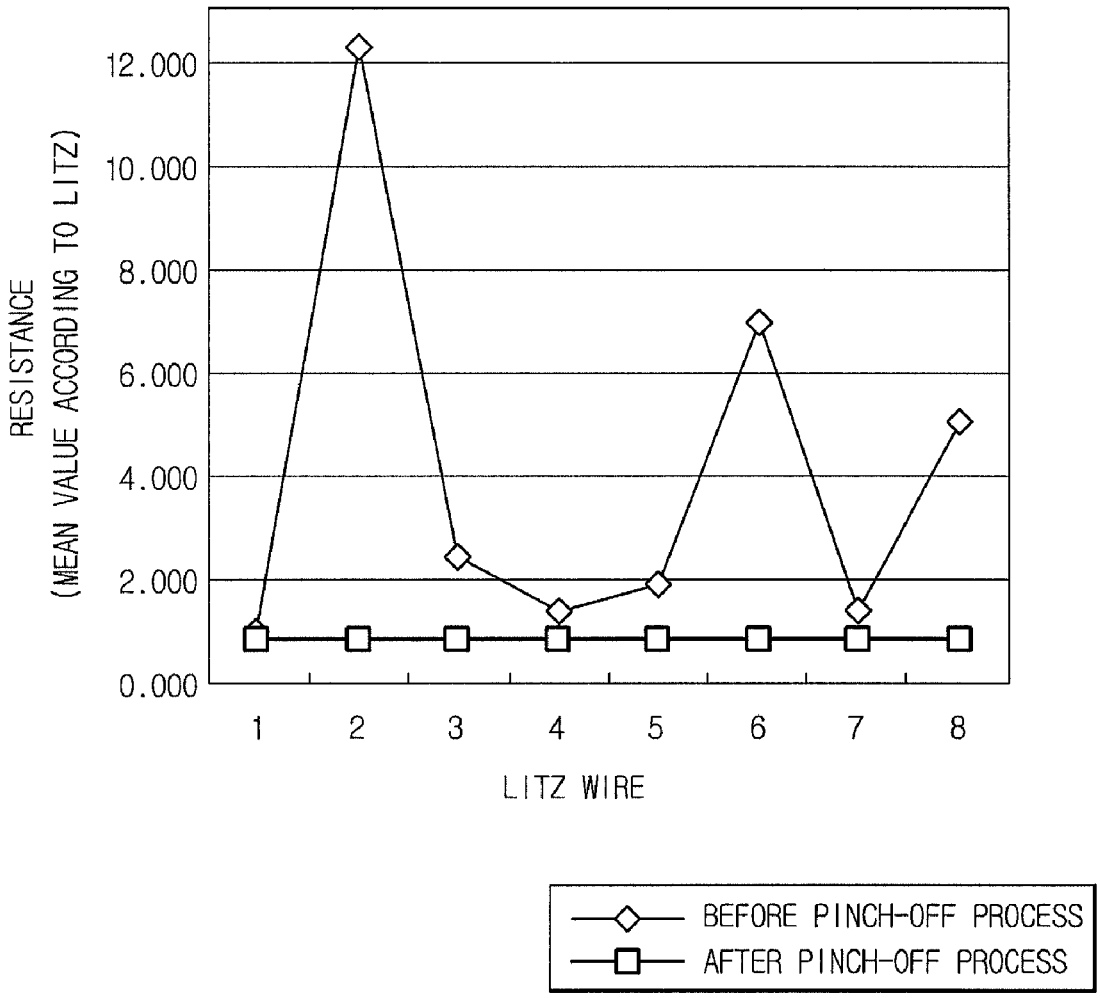
FIG. 12 is a graph illustrating resistance values of the litz wire before and after the pinch-off process.

FIG. 12 is a graph more accurately comparing the resistance values represented in the above Table. From FIG. 12, it can be seen that the resistance values of the 8 litz wires constituting the litz wire 43*a* after the pinch-off process are greatly lowered, compared with the resistance values of 8 litz wires constituting the litz wire 43*a* before the pinch-off process, and a deviation of the resistance values of the 8 litz wires constituting the litz wire 43*a* is greatly reduced.

Although this embodiment illustrates that the connection terminal 45 and the litz wire 43*a* are effectively connected by performing both the removal of the sheaths of the wires through heating of the connection terminal 45 and the cutting of the connection terminal 45 and the litz wire 43*a* through the pinch-off process, the litz wire 43*a* and the connection terminal 45 may be connected only by performing one of the removal of the sheaths of the wires and the cutting of the connection terminal 45 and the litz wire 43*a*.

Further, although this embodiment illustrates that the sheaths of the wires are removed under the condition that one end of the litz wire 43*a* is installed within the connection terminal 45, the sheaths of the wires may be removed through a separate process and then ends of the wires may be installed within the connection terminal 45.

Moreover, although this embodiment illustrates that the connection terminal 45 is deformed and cut through the pinch-off process, if the connection terminal 45 is only deformed through the pinch-off process, intervals between the wires constituting the litz wire 43*a* and intervals between the cores of the wires may be narrowed and thus the wires may be more effectively connected.

As is apparent from the above description, in a connection terminal of a litz wire which supplies power from an external power source to the litz wire, a mounting method thereof, and a manufacturing method of a cooking appliance with a working coil consisting of the litz wire in accordance with one embodiment of the present invention, sheaths of wires constituting the litz wire are removed in the above-described fashion, and thus the litz wire is more effectively connected to the connection terminal.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A mounting method of a connection terminal of a litz wire comprising:

preparing the litz wire including plural wires, each of the plural wires including a core made of a conductive material, and a sheath provided at the outer surface of the core and made of an insulating material;

installing one end of the litz wire at the connection terminal;

removing the sheaths from the plural wires disposed in the connection terminal by heating the connection terminal;

cutting and deforming a fixing part of the connection terminal through a pinch-off process; and contacting and electrically connecting the cores to each other by the cutting and deforming of the fixing part.

2. The mounting method according to claim 1, wherein the fixing part of the connection terminal is deformed such that an interval between both sides of the fixing part become narrowed, and is cut together with the end of the litz wire through the pinch-off process.

3. The mounting method according to claim 1, wherein at least a part of residues of the sheaths removed from the plural wires is removed by narrowing intervals between the plural wires through the pinch-off process.

4. The mounting method according to claim 1, wherein the litz wire is heated through the connection terminal by heating the connection terminal under the condition that the end of the litz wire is installed at the connection terminal.

5. The mounting method according to claim 4, wherein the pinch-off process is performed under the condition that the connection terminal is heated.

6. The mounting method according to claim 4, wherein the connection terminal and the plural wires from which the sheaths are removed are fused to each other by continuously heating the connection terminal.

7. The mounting method according to claim 1, wherein the connection terminal includes a ring connection part formed in a ring shape.

8. The mounting method according to claim 7, wherein the litz wire is installed at the connection terminal in a first direction, and the ring connection part is extended in a second direction.

9. The mounting method according to claim 1, wherein:

the connection terminal includes the fixing part where the litz wire is installed; and the fixing part is deformed to have a ring shape in which both ends of the fixing part in the widthwise direction thereof are opposite to each other so as to allow the litz wire to be fixed to the inside of the fixing part.

10. The mounting method according to claim 9, wherein the fixing part has a width set to be 105~115% of a circumferential length of the litz wire.

11. The mounting method according to claim 1, wherein:

the core is made of aluminum; and the sheath is made of enamel.

12. The mounting method according to claim 11, wherein the sheath of each wire is removed by heating the connection terminal at which the litz wire is installed to a temperature of 230~300° C.

13. A connection terminal of a litz wire comprising a fixing part in which the litz wire including a plurality of wires, each of the plural wires including a core made of a conductive material, and a sheath provided at the outer surface of the core and made of an insulating material, wherein the fixing part is formed by cutting and deforming by a pinch-off apparatus such that an interval between both sides of the fixing part become narrowed, and the cores are in contact with each other and electrically connected to each other by the cutting and deforming of the fixing part.

14. The connection terminal according to claim 13, wherein the fixing part is deformed to have a ring shape in which both ends of the fixing part in the widthwise direction thereof are opposite to each other so as to allow the litz wire to be fixed to the inside of the fixing part.

15. The connection terminal according to claim 14, wherein the fixing part has a width set to be 105~115% of a circumferential length of the litz wire.

16. The connection terminal according to claim 13, wherein the connection terminal includes a ring connection part extended from one side of the fixing part in a direction perpendicular to a direction in which the litz wire is installed in the fixing part.

17. A manufacturing method of a cooking appliance, which has a cooking table on which cooking containers containing food are placed, working coils to heat the cooking containers, and connection terminals respectively installed at the working coils, comprising:

preparing a litz wire including plural wires, each of the plural wires including a core made of a conductive material, and a sheath provided at the outer surface of the core and made of an insulating material;

installing one end of the litz wire at a fixing part provided on the connection terminal to install the litz wire;

removing the sheath from each of the plural wires disposed in the connection terminal by heating the connection terminal;

cutting and deforming a portion of the fixing part together with the end of the litz wire through a pinch-off process; and contacting and electrically connecting the cores to each other by the cutting and deforming of the fixing part.

18. The manufacturing method according to claim 17, wherein the working coils are formed by disposing the litz wire in a spiral shape.

19. The manufacturing method according to claim 17, wherein the fixing part is deformed to have a ring shape in which both ends of the fixing part in the widthwise direction thereof are opposite to each other so as to allow the end the litz wire to be installed at the inside of the fixing part.

20. The manufacturing method according to claim 19, wherein the fixing part has a width set to be 105~115% of a circumferential length of the litz wire.

21. The manufacturing method according to claim 17, wherein the sheath of each of the plural wires constituting the litz wire is removed by heating the fixing part of the connection terminal in which the litz wire is installed to a temperature of 230~300° C.

* * * * *

UNITED STATES PATENT AND TRADEMARK OFFICE

CERTIFICATE OF CORRECTION

PATENT NO. : 8,196,299 B2
APPLICATION NO. : 12/877749
DATED : June 12, 2012
INVENTOR(S) : Sung Ho Lee et al.

It is certified that error appears in the above-identified patent and that said Letters Patent is hereby corrected as shown below:

First Page Col. 1 (Foreign Application Priority Data), Line 3, Delete "Sep 08, 2010" and insert -- Sep 08, 2009 --, therefor.

Signed and Sealed this
Twenty-seventh Day of November, 2012

David J. Kappos

David J. Kappos
*Director of the United States Patent and Trademark Office*